United States Patent [19]

Boser

[11] Patent Number: 4,996,933

[45] Date of Patent: Mar. 5, 1991

[54] METHOD FOR FOLDING ZIPPER SIDE TAPES AND GARMENT PANEL EDGES FOR ATTACHMENT THEREOF

[76] Inventor: Ronald J. Boser, 711-3 Koehler Ave., Ronkonkoma, N.Y. 11779

[21] Appl. No.: 478,486

[22] Filed: Feb. 12, 1990

[51] Int. Cl.[5] ..... D05B 35/06; D05B 35/10; A44B 19/00

[52] U.S. Cl. ..... 112/265.2; 112/152; 112/105; 112/147; 112/265.1; 112/136; 112/104; 2/265

[58] Field of Search ..... 2/257, 265; 112/80.32, 112/113, 114, 115, 136, 138, 105, 106, 147, 152, 121.18, 163, 265.1, 265.2

[56] References Cited

U.S. PATENT DOCUMENTS

| | | | |
|---|---|---|---|
| 2,073,380 | 3/1937 | Roseman | 112/265.2 X |
| 2,131,250 | 9/1938 | DeVoe | 112/152 X |
| 2,776,635 | 1/1957 | Blumenkranz | 112/105 |
| 2,977,904 | 4/1961 | Carmen | 112/147 X |
| 3,085,525 | 4/1963 | Roseman et al. | 112/105 |
| 3,777,314 | 12/1973 | Boser | 2/265 |
| 3,962,729 | 6/1976 | Cook | 2/265 X |

*Primary Examiner*—Werner H. Schroeder
*Assistant Examiner*—Ismael Izaguirre

[57] ABSTRACT

The sewing attachment of a jacket front panel zipper in which the edges of the zipper side tapes are folded into inwardly facing C shapes and the left and right jacket front panel edges into outwardly facing C shapes, and these inwardly and outwardly facing C shapes are interfolded with each other and held in this relationship by the zipper attaching seams, with the result that the cut edges of the sewn together components are hidden within the folding from view to thereby enhance the appearance of jacket.

3 Claims, 3 Drawing Sheets

METHOD FOR FOLDING ZIPPER SIDE TAPES AND GARMENT PANEL EDGES FOR ATTACHMENT THEREOF

The present invention relates generally to the sewing attachment of a closure zipper to the front of a garment, and more particularly to improvements in the folding of the zipper side tapes and garment front panel edges, between which the zipper is attached, which results in the completed assembly with all cut, or raw, edges of the sewn materials being covered, and thus masked from view, to thereby significantly enhance the appearance of the garment.

BACKGROUND OF THE INVENTION

1. Field of the Invention

In many prior patents the method of sewing a zipper down along the front of a garment is described and illustrated. Exemplary of these patents is U.S. Pat. No. 3,777,314 issued to Boser on Dec. 11, 1973 in which, to enhance the appearance of the garment, the zipper position is behind finished edges of the garment left and right front panels. However, in this and all other known zipper attachment methods, a purchaser or user of the garment can still observe the cut, and thus raw, edges of the zipper side tapes which are exposed to view on the inside of the garment, thus often requiring additional and expense-adding finishing operations.

2. Summary of the Invention

In the within inventive zipper attachment method it is an object to overcome the foregoing and other shortcomings of the prior art. More particularly, it is an object during the attachment of the zipper to the garment, to provide a covered, and thus finished appearance, not only to the garment panel edges, but also to the edges of the zipper side tapes, so that with respect to the zipper, the garment both on its outside and inside, has an enhanced appearance, all as will be explained in greater detail subsequently herein.

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF A PREFERRED EMBODIMENT

Before proceeding with a description of the inventive method using the just described drawing figures, it will be understood that references to the description of drawings left side and right side will be in relation to the garment wearer's left and right and not the left and right side of the garment as seen by an observer. Also, references to outside and inside will refer to the garment surface that occupies this position in the normal way that the garment is worn.

Figure 1:
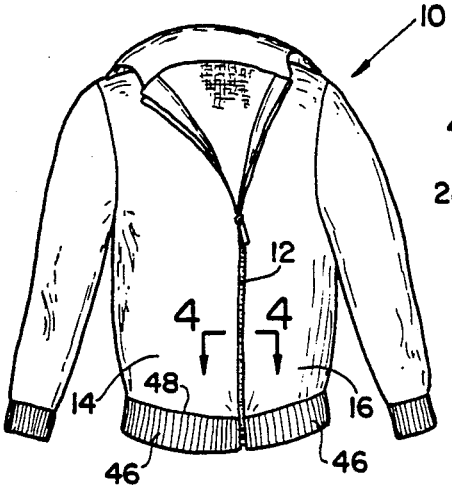
FIG.1 PRIOR ART
FIG. 1 is a perspective view of a garment using a prior art zipper attachment method.

Referring to the drawings, there is shown in FIG. 1 a jacket or other typical upper torso garment 10 which as a closure uses a zipper 12 that is sewn between a right front panel 14 and a left front panel 16. Although the prior art and the present inventive zipper attachment methods are both applicable to many types of garments, the description which follows will be in connection with a single ply, jersey type garment material typically used for exercise clothing.

Figure 2:
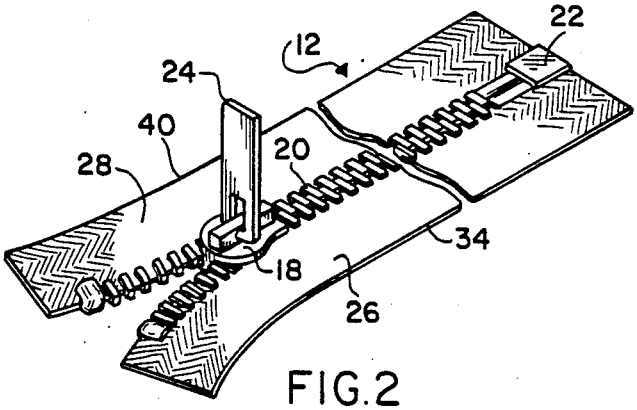
FIG.2 PRIOR ART
FIG. 2 is a detailed perspective view of a typical zipper used in the prior art method of FIG. 1.

A standard slide fastener chain or zipper 12 is shown in FIG. 2 to include slider 18 that is used to interlock coupling elements or teeth 20 after the zipper bottom connecting link 22 has been engaged. Slider 18 has an accessible pull tab 24, and, as well understood, zipper 12 is completed by teeth 20 that are divided alternately and are respectively connected to right and left side tapes 26 and 28.

Figure 3:
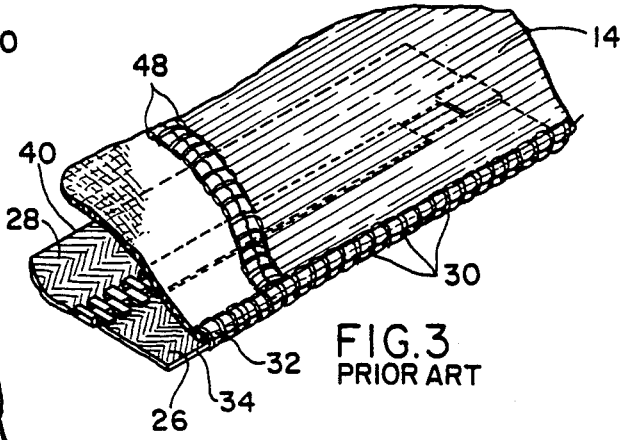
FIG.3 PRIOR ART
FIG. 3 is a detailed perspective view of an initial sewing step of said prior art method provided as background for better understanding the within inventive zipper attachment method.
Figure 4:
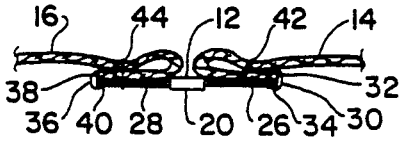
FIG.4 PRIOR ART
FIG. 4 is a sectional view as taken along line 4—4 of FIG. 1.
Figure 5:
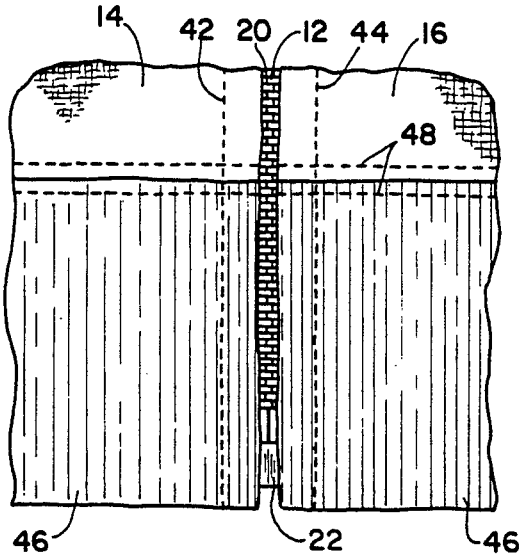
FIG.5 PRIOR ART
FIG. 5 is a detailed partial front elevation of the zipper attachment of the prior art garment of FIG. 1.

Assembled zipper 12, i.e. with side tapes 26, 28, is first joined, as best shown in FIG. 3, along a seam 30 to the garment right side panel 14 whose cut, and thus raw, edge 32 is connected to the selvage, and equally raw edge 34 of tape 26. A similar purpose attaching seam 36 is made along the length of the cut edge 38 of the garment left front panel 16 and the selvage edge 40 of the left side zipper tape 28 as best shown in FIG. 4. Seams 30 and 36 are machine made with an appropriate stitch that gathers and binds edges 32,34 and 36, 38 to prevent unravelling thereof along their common length. After seams 30 and 36 are completed, panels 14 and 16 are folded away from zipper 12 and respectively stitched with basic top stitch seams 42 and 44, as shown in FIG. 4. A detailed front elevational view of the lower end of the prior art zipper and panel assembly is shown in FIG. 5. Zipper 12 and panels 14, 16 are assembled so that they are positioned on the outside of the garment, as shown in FIG. 4. In practice, many jackets 10 are finished with a seam 48 that attaches to it an elastic knit band 46. For simplicity, patch pockets in the lower area of panels 14 and 16 are merely referred to, but not shown or described.

Figure 6:
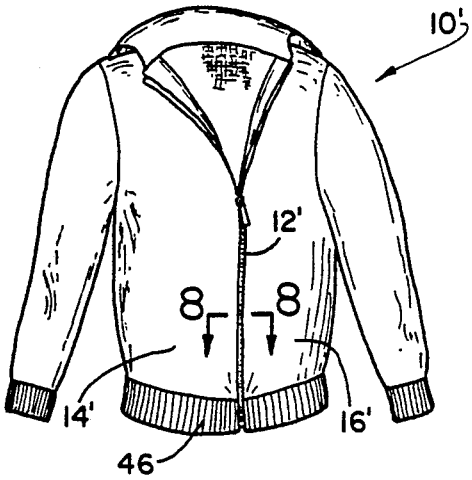
FIG. 6 is a view similar to FIG. 1, but of a garment using the zipper attachment method according to the present invention.

In accordance with the present invention, and as shown in FIG. 6, a jacket 10' is illustrated as having a zipper 12' sewn between a right front panel 14' and a left front panel 16'. As previously mentioned, the present invention will now be described in connection with a single ply, jersey type garment, as was the prior art, so that the comparison will highlight the patentable differences.

Figure 8:
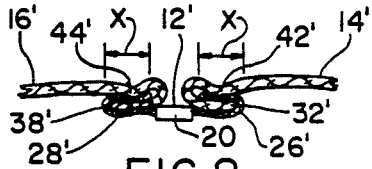
FIG. 8 is a sectional view as taken along line 8—8 of FIG. 6.
Figure 17:
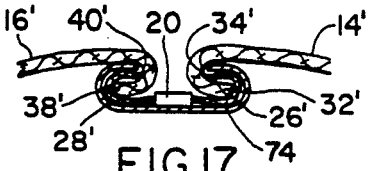
FIGS. 13 through 17 are sectional views taken respectively along lines 13 through 17 of FIG. 11 showing in a progressive manner the folding and relationship of the parts being sewn during the practicing of the within inventive zipper attachment method.
Figure 16:
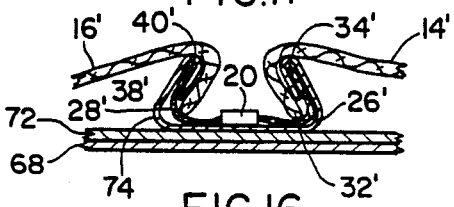
Figure 7:
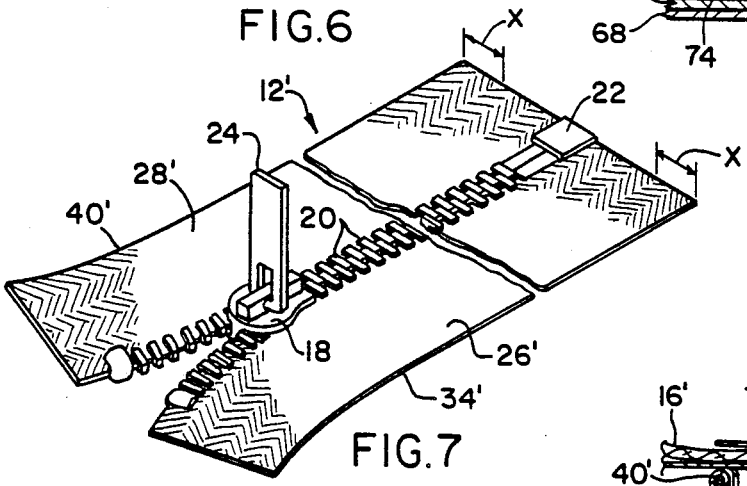
FIG. 7 is a view similar to FIG. 3, but showing the zipper used in the within inventive method.
Figure 9:
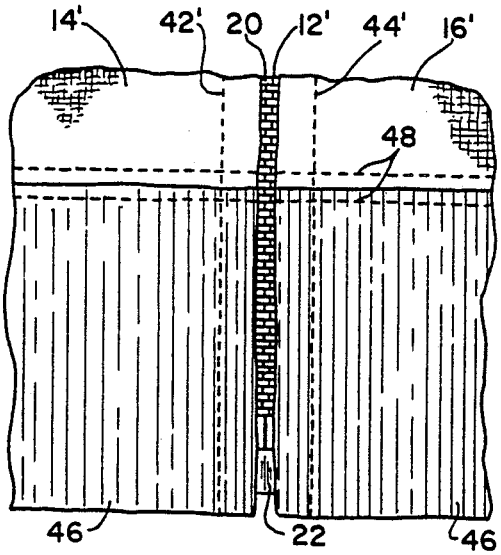
FIG. 9 is a view similar to FIG. 5, but again showing details of the zipper attachment method according to the present invention.
Figure 14:
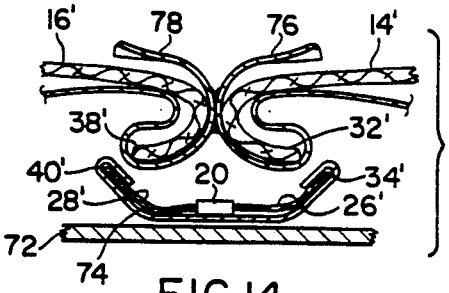

In FIG. 7, zipper 12' includes a slider 18, teeth 20, connecting link 22 and pull tab 24, as did the prior art zipper 12. Zipper 12' likewise has right and left side tapes respectively designated 26' and 28', that preferrably are wider in dimension than zipper 12 tapes 26 and 28, the same being herein denoted as a distance "X" on each side. As best shown in FIG. 8, the right and left tape extra widths "X" are used to advantage as material that is reversely folded over the respective cut edges 32' and 38' of panels 14' and 16'. Panels 14' and 16' additionally are adapted to be folded back, by virtue of the respective "X" widths, over the edges of tape 26' and 28' in an interlocking pattern, all as will be subsequently explained in detail. While held in this configuration, seams 42' and 44' can be machine sewn singularly on a single needle machine or sewn concurrently on a two or double needle machine. A comparison of FIG. 9 with prior art FIGS. 4 and 5 is helpful in that it reveals that both techniques provide a finished garment in which each has an identical appearance on the outside, while the gathering seams 30 and 36 on the inner side of the prior art garment are eliminated in the garment of the latter or within inventive technique.

Figure 10:
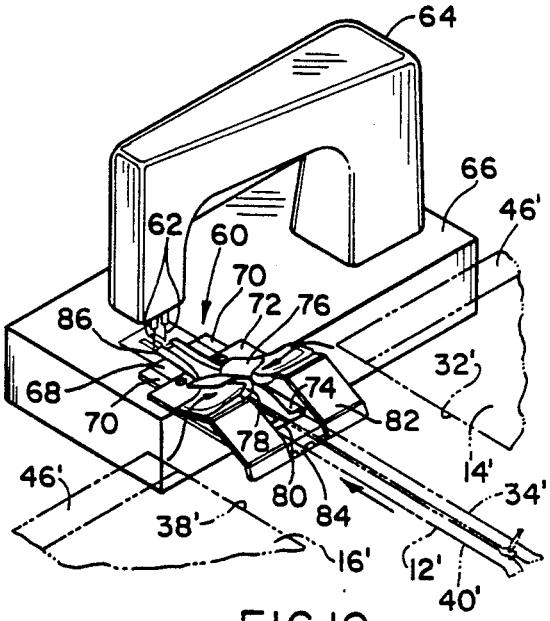
FIG. 10 is a perspective view of a sewing machine and scroll accessory that is preferred to be used to practice the zipper attachment method of the present invention.
Figure 11:
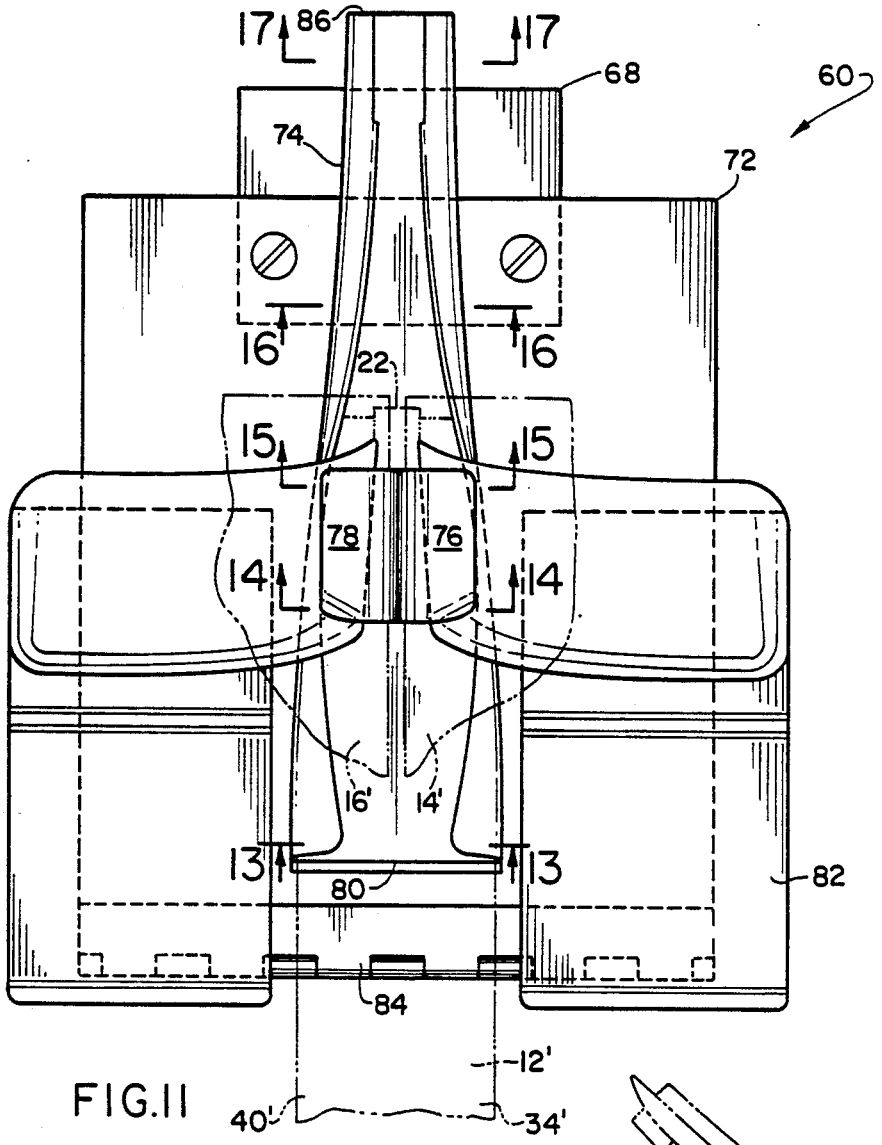
FIG. 11 is a detailed plan view, on an enlarged scale, of the scroll shown in FIG. 10.

The assembly of zipper 12' between panels 14' and 16' can be done by hand with assistance of basting stitches, pins and/or clamps (not shown) on a standard sewing machine. However, it is preferred to be practiced using sewing machine accessories, such as a guide chute 60, as shown in FIG. 10, to facilitate the folding and handling of the zipper and garment panels. Chute 60 is shown mounted centrally with respect to the double needles 62 of sewing machine 64. Chute 60 can be fastened to the base 66 of machine 64 by screws or bolts in a conventional manner or by using a standard quick connect/disconnect plate 68 (not detailed) which nests in mating stanchions 70 (FIG. 10). Guide chute 60 has a base plate 72 attached to plate 68, which supports a zipper scroll 74 and a pair of right and left panel scrolls 76 and 78 respectively (FIG. 11). Scrolls 74, 76, and 78 are conventionally formed of sheet metal construction material.

Zipper scroll 74 has a proximal end 80 where zipper 12' is hand fed with pull tab 24 facing upward and connecting link 22 on the lead end. This orientation puts tape 26' on the right to be joined to right side panel 14' and tape 28' on the left to be joined to left side panel 16'. Scroll 74 is progressively shaped, as shown in the series of FIGS. 13–17, to correspondingly progressively fold the respective right and left selvage edges 34' and 40' over the respective edges 32' and 38' of the right and left front panels 14' and 16', as both zipper and garment panels, in a well understood manner, are urged through movement by the sewing machine feed dogs in a sewing path, as noted by the arrow in FIG. 10, towards the sewing needles 62 of the sewing machine 64.

Scrolls 76 and 78 are supported on a yoke type frame 82 which is hingedly connected to base plate 72 at hinge 84.

Figure 13:
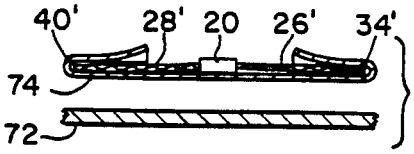

As shown in FIG. 13, the operator first places zipper 12' into scroll 74 in a flat configuration and advances the lead end forward to just beyond the position of scrolls 76 and 78 as noted in FIG. 11. The advancement of the lead end of zipper 12' is conducted to a point beyond the FIG. 14 position to the FIG. 15 position at which the selvage edges 34' and 40' are turned upright in a half folded position in which each edge has an inwardly facing C configuration.

Figure 15:
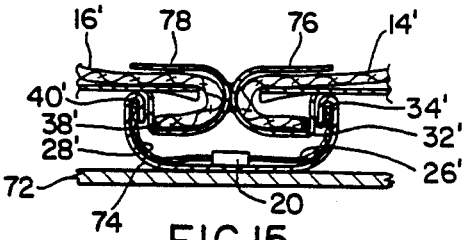
Figure 12:
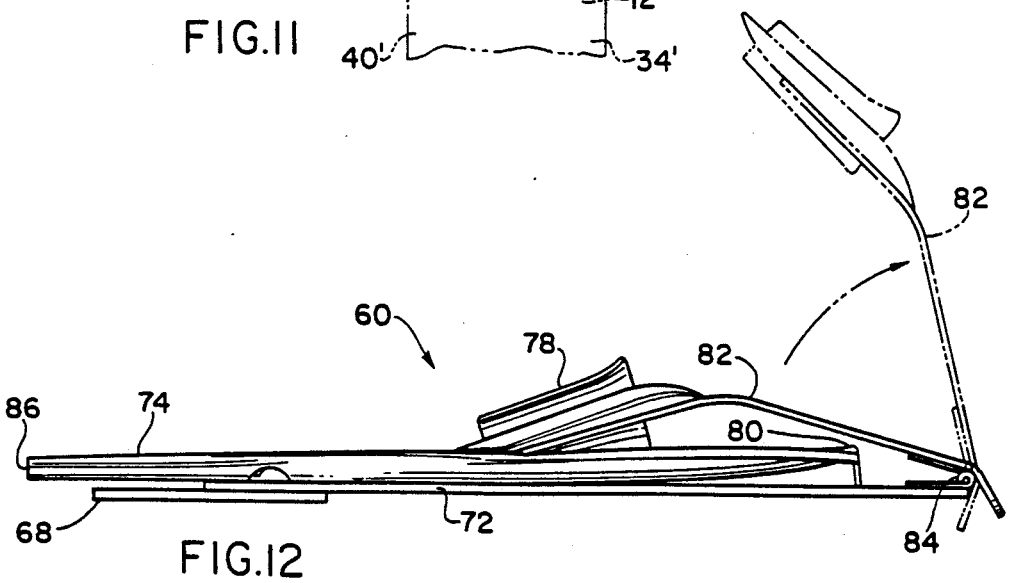
FIG. 12 is a left side elevation of the scroll projected from FIG. 11.

Next, the operator brings the edges 32' and 38' of the respective right and left garment panels 14' and 16' into cooperating right and left folding scrolls 76 and 78 and, in so doing, manipulates the panels so that the lead corners are fully within the scrolls and slightly in advance of connecting link 22 of zipper 12' (FIGS. 11 and 15). When inserting scrolls 76 and 78 with respective edges of panels 14' and 16', the operator may lift yoke frame 82 about hinge 84 to better observe the scroll loading operation, as noted by the full line and phantom line illustrations in FIG. 12.

In the next method step, the operator continues manipulation of the panels 14' and 16' and zipper 12' in forward movement along the feed path towards and beyond the distal end 86 of scroll 74 into the sewing station occupied by the sewing needles 62. In advancing zipper 12' and panels 14' and 16', the operator moves these materials to be sewn past the FIG. 16 location, at which the inwardly facing C shapes induced in the zipper side panel edges by the edge-folding walls of the zipper scroll 74 and the outwardly facing C shapes induced in the outwardly facing C shapes by the edge-folding walls of the scrolls 76, 78 in panels 14' and 16' are partly interfolded, and then through the FIG. 17 location at which these outwardly and inwardly facing C shapes are fully interfolded ready to be sewn by the top stitching seams 42', 44'. Cut edge 32' on panel 14' thus becomes wrapped or assumes a covering position about the folded edge of tape 26' and cut edge 40' on panel 16' similarly becomes wrapped about the folded edge of tape 28'. After the initial stitches of seams 42', 44' are applied at the sewing station, the operator merely guides panels 14' and 16' towards and into scrolls 76 and 78 as the sewing machine feed dogs assume the function of advancing the joined components for application of the seams 42' and 44' to complete the sewing attachment of zipper 12' to the garment front panels 14' and 16' in spanning relation between the opposing edges of these panels.

It can perhaps be noted best from the plan view of FIG. 11 that the spacing between the edge-folding walls of zipper scroll 74 converges inwardly from a prescribed distance as at a location coincident with the sectional lines 15—15 to a diminished distance at the distal end 86 thereof, to complete the interfolding of the C shapes of the sewn materials. The spacing at the location noted by the lines 15—15 will be understood to be selected to be of a sufficient extent to permit the panel edges to be projected from above through the scrolls 76 and 78 so as to enter into the fold being formed in the edges of the zipper side tapes, all as is shown by the phantom perspective line illustrations of these components being sewn superimposed on the full line illustration of the follding scrolls in FIG. 11.

While the particular sewing method and sewing machine scroll accessories for practicing said sewing method herein shown and disclosed in detail are fully capable of attaining the objects and providing the advantages hereinbefore stated, it is to be understood that they are merely illustrative of the presently preferred embodiment of the invention and that no limitations are intended to the detail of construction or design herein shown other than as defined in the appended claims.

What is claimed is:

1. The method for attaching a zipper with a sewing machine wherein said zipper comprises opposite side tapes in an interposed position along opposing edges of a pair of front panels of a garment, the improvements comprising the steps of simultaneously urging through movement of said zipper along a sewing path towards sewing needles of a sewing machine and in a clearance position thereabove said garment front panels, folding the opposite edges of the side tapes of said zipper by using a first scroll with edge-folding walls in inwardly facing relation to said sewing path so as to form corresponding inwardly facing C shapes in said tape edges, folding the edges of said garment front panels by using a second scroll with edge-folding walls in outwardly facing relation to said sewing path so as to form corresponding opposite outwardly facing C shapes in said panel edges, disposing the outwardly facing C shape formed in each garment panel edge in covering relation about a corresponding edge of a cooperating inwardly facing C shape formed in the edge of a zipper side tape so that said outwardly and inwardly facing C shapes are in interengaged relation, and sewing together the interengaged C shapes so as to attach said zipper in spanning relation between the opposing edges of said garment front panels, whereby the edges of said zipper side tapes are enclosed in the folds of the edges of said garment front panels to thereby contribute to an enhanced finished appearance in the attached zipper.

2. The method of attaching a zipper to a garment as claimed in claim 1 wherein the edge-folding walls of said first scroll for folding said zipper side tape edges are inwardly converging along said sewing path progressively from a prescribed spaced apart distance to a diminished distance at said sewing machine sewing needles, and said garment front panel edges are inserted at said prescribed spaced apart distance in an initial fold being formed thereat in said opposite zipper side tape edges, whereby at said diminished distance of said first scroll the folding of said garment front panel edges is simultaneously completed with the folding of said zipper side tape edges to thereby interengage said outwardly and inwardly facing C shapes of the cooperating edges of said zipper and garment front panels.

3. The method of attaching a zipper to a garment as claimed in claim 2 wherein each garment front panel edge in an outwardly facing C shape formed therein is projected from a clearance position above a cooperating one of said edge-folding walls of said first scroll to a position slightly below the top of said wall, whereby said garment front panel edge is enclosed in the inwardly facing C shape formed in the edge of said zipper side tape by said scroll edge-folding wall such that the portion of said garment front panel adjacent said engaged edges is then adapted to assume said covering relation over said edge of said zipper side tape.

* * * * *